US008720684B2

(12) United States Patent
Balmer et al.

(10) Patent No.: US 8,720,684 B2
(45) Date of Patent: May 13, 2014

(54) PACKAGING SYSTEM FOR A FLOOR PANEL

(75) Inventors: Richard H. Balmer, Manheim, PA (US); Shih Chung Lee, Taipei (TW); Dung V. Dao, Lititz, PA (US); Christopher R. Knafelc, Ephrata, PA (US); Heath E. Harrington, Columbia, PA (US); Kean M. Anspach, Quarryville, PA (US); Michael E. Buckwalter, New Providence, PA (US); John R. Eshbach, Jr., Marietta, PA (US)

(73) Assignee: AWI Licensing Company, Wilmington, DE (US)

( * ) Notice: Subject to any disclaimer, the term of this patent is extended or adjusted under 35 U.S.C. 154(b) by 365 days.

(21) Appl. No.: 12/859,566

(22) Filed: Aug. 19, 2010

(65) Prior Publication Data

US 2011/0042252 A1 Feb. 24, 2011

Related U.S. Application Data

(60) Provisional application No. 61/235,781, filed on Aug. 21, 2009.

(51) Int. Cl.
*B65D 85/46* (2006.01)
*B65D 85/48* (2006.01)
*E04B 2/00* (2006.01)

(52) U.S. Cl.
USPC ..... 206/321; 206/449; 52/591.4; 52/451; 52/462

(58) Field of Classification Search
USPC ..... 206/321, 584, 585, 593, 591, 449, 453, 206/586, 323, 322; 52/591.4, 609, 451, 52/462, 741.3, 610; 53/447, 475
See application file for complete search history.

(56) References Cited

U.S. PATENT DOCUMENTS 2,043,419 A * 6/1936 Robinson ..... 206/454
2,737,693 A 3/1956 Robbins (Continued)

FOREIGN PATENT DOCUMENTS

AU 2006201915 B1 5/2007
AU 2006252200 B2 7/2007

(Continued)

OTHER PUBLICATIONS

Lowe's Home Center, Inc.'s Surface Source point-of-sale materials.

*Primary Examiner* — Mickey Yu
*Assistant Examiner* — Chun Cheung
(74) *Attorney, Agent, or Firm* — Amy M. Fernandez

(57) ABSTRACT

A packaging system and a method of packaging a plurality of floor panels in a box includes floor panels having a top layer and a bottom layer. The top layer has a top surface with a visible decorative pattern and a bottom surface adhered to a top surface of the bottom layer such that the bottom layer is offset from the top layer in a direction of length and width and a marginal end portion of the top surface of the bottom layer and a marginal end portion of the bottom surface of the top layer is exposed. At least one of the marginal end portions has an adhesive. The floor panels are stacked in the box in pairs. Each of the pairs is stacked such that the top surfaces of the top layers of each of the pairs of the floor panels are facing each other.

18 Claims, 8 Drawing Sheets

(56) References Cited

U.S. PATENT DOCUMENTS

| | | | | |
|---|---|---|---|---|
| 2,914,815 | A | 12/1959 | Alexander | |
| 3,866,267 | A | 2/1975 | Poletti | |
| 3,902,293 | A | 9/1975 | Witt et al. | |
| 3,988,187 | A | 10/1976 | Witt et al. | |
| 4,242,390 | A | 12/1980 | Nemeth | |
| 4,489,115 | A | 12/1984 | Layman et al. | |
| 4,649,069 | A | 3/1987 | Tone | |
| 4,766,022 | A | 8/1988 | Tone | |
| 4,804,569 | A | 2/1989 | Arisawa | |
| 4,941,309 | A | 7/1990 | Fluent et al. | |
| 5,045,389 | A | 9/1991 | Campagna | |
| 5,181,814 | A | 1/1993 | Woods et al. | |
| 5,382,462 | A | 1/1995 | Pacione | |
| 5,522,500 | A * | 6/1996 | Mori | 206/308.1 |
| 3,270,473 | A | 9/1996 | Smith | |
| 5,750,227 | A * | 5/1998 | Adams | 52/390 |
| 5,894,700 | A | 4/1999 | Sweet | |
| 6,298,624 | B1 | 10/2001 | Pacione | |
| 6,306,477 | B1 | 10/2001 | Pacione | |
| 6,395,362 | B1 | 5/2002 | Pacione | |
| 6,460,303 | B1 | 10/2002 | Pacione | |
| 6,751,917 | B2 | 6/2004 | Mao | |
| 6,797,353 | B1 | 9/2004 | Pacione | |
| 6,802,167 | B2 | 10/2004 | Pacione | |
| 7,155,871 | B1 | 1/2007 | Stone et al. | |
| 7,185,465 | B2 | 3/2007 | Pacione | |
| 7,185,473 | B2 | 3/2007 | Pacione | |
| 7,194,843 | B2 | 3/2007 | Pacione | |
| 7,322,159 | B2 | 1/2008 | Stone et al. | |
| 7,383,663 | B2 | 6/2008 | Pacione | |
| 7,412,806 | B2 | 8/2008 | Pacione et al. | |
| 7,458,191 | B2 | 12/2008 | Stone | |
| 7,942,262 | B2 * | 5/2011 | Watanabe et al. | 206/321 |
| 2004/0004016 | A1 * | 1/2004 | Rawat | 206/449 |
| 2005/0076606 | A1 | 4/2005 | Curtis | |
| 2006/0185303 | A1 | 8/2006 | Pacione et al. | |
| 2007/0079572 | A1 | 4/2007 | Pacione | |
| 2007/0204428 | A1 | 9/2007 | Pacione | |
| 2007/0204556 | A1 | 9/2007 | Pacione | |
| 2008/0172968 | A1 | 7/2008 | Pacione | |
| 2008/0289277 | A1 | 11/2008 | Stone | |
| 2009/0031657 | A1 | 2/2009 | Pacione | |
| 2009/0038251 | A1 | 2/2009 | Pacione | |

FOREIGN PATENT DOCUMENTS

| | | | |
|---|---|---|---|
| CA | 2260073 | C | 1/1998 |
| CA | 2513973 | A1 | 8/2004 |
| CA | 2568978 | | 2/2009 |
| JP | 2007182750 | A | 7/2007 |
| JP | 2007182751 | A | 7/2007 |

* cited by examiner

PACKAGING SYSTEM FOR A FLOOR PANEL

CROSS-REFERENCE TO RELATED APPLICATIONS

This application claims priority from U.S. patent application Ser. No. 61/235,781, filed Aug. 21, 2009, which is hereby incorporated by reference in its entirety.

FIELD OF THE INVENTION

The present invention relates to a packaging system for a floor panel, wherein the floor panel comprises a top layer and a bottom layer adhered together in an offset relationship such that a marginal end portion of a top surface of the bottom layer and a marginal end portion of a bottom surface of the top layer are exposed.

BACKGROUND OF THE INVENTION

Floor panels for use in floating floor systems typically comprise a top layer and a bottom layer adhered together in an offset relationship such that a substantially L-shaped marginal end portion of a top surface of the bottom layer and a substantially L-shaped marginal end portion of a bottom surface of the top layer are exposed. The top layer typically comprises at least one mix layer, a print film, a wear layer, and a top coat. The bottom layer typically comprises at least one mix layer. The bottom layer has a thickness about equal to or greater than the top layer. A ratio of a thickness of the top layer to a thickness of the bottom layer is typically in the range of about 2 or less. For example, the SURFACE SOURCE product sold by Lowe's Home Centers, Inc. has a top layer with a thickness of about 64 mils (about 1.63 millimeters), and a bottom layer with a thickness of about 61 mils (about 1.55 millimeters). Thus, the ratio of the thickness of the top layer to the bottom layer is about 1.05 (64 mils/61 mils=1.05).

In order to assemble the floating floor system, at least one of the marginal end portions of each of the floor panels is provided with an adhesive. The marginal end portion provided with the adhesive is engaged with the marginal end portion of an adjacent floor panel to form the floating floor system. The floor panels may be formed, for example, such that when the floating floor system is assembled on a sub-floor ends of the top layers of the adjacent floor panels substantially abut, while ends of the bottom layers of the adjacent floor panels are spaced apart a desired distance so that a gap is formed there between. Alternatively, the floor panels may be formed, for example, such that when the floating floor system is assembled on the sub-floor the ends of the top layers of the adjacent floor panels substantially abut and the ends of the bottom layers of the adjacent floor panels substantially abut.

Because the thickness of the bottom layer is significantly large (about 98 mils (about 2.5 millimeters)), when the floor panels are assembled such that a gap is formed between the ends of the bottom layers of the adjacent floor panels, the gap can telescope through the floor panels thereby significantly altering the aesthetic and structural characteristics of the top layer. For example, the gaps may cause buckling at a top surface of the top layer. Alternatively, when the floor panels are assembled such that the ends of the bottom layers of the adjacent floor panels substantially abut, unwanted gaps or overlapping can occur between the ends of the bottom layers due to deviations in the size of the marginal end portions and/or errors occurring during installation. These unwanted gaps or overlaps can additionally telescope through the floor panel thereby also significantly altering the aesthetic and structural characteristics of the top layer.

Additionally, the marginal end portions of the top layer of a first row of the floor panels, which are typically positioned adjacent a wall, remain unsupported when the floating floor system is assembled, because the marginal end portions of the top layer of the first row of the floor panels will not engage with an adjacent floor panel. Thus, because the thickness of the bottom layer is significantly large, the gap occurring between the sub-floor and the marginal end portion of the top layer will also negatively impact the aesthetic and structural characteristics of the top layer. For example, buckling at the top surface of the top layer can occur. Also, because the bottom layer and the top layer comprise mix layers, which contain fillers, the bottom layer and the top layer are prone to absorb moisture thereby further affecting the aesthetic and structural characteristics of the floor panels. This is particularly problematic, since the bottom layer is installed directly on a sub-floor.

Still further, because the bottom layer has a thickness greater than the top layer, when the floor panels are stacked, for example, during shipping, a space exists between the marginal end portions of the top layer of the adjacent flooring panels equal to the thickness of the bottom layer. Thus, during shipping, the unsupported marginal end portions of the top layer are prone to bend and/or curl an amount equal to the thickness of the bottom layer. Because of the structural characteristics of the top layer, these bends and/or curls remain in the marginal end portions of the top layer during installation and can thereby significantly alter the aesthetic and structural characteristics of the floor panel. For example, buckling can occur at the top surface of the top layer and/or the bond strength between the marginal end portions of the adjacent floor panels could be negatively affected.

In view of the foregoing, there still remains a need to develop a floor panel that overcomes the above-described problems. Additionally, there still remains a need to develop a packaging system and a method for packaging the floor panels to prevent damage to the floor panels during shipping.

BRIEF SUMMARY OF THE INVENTION

A packaging system and a method of packaging a plurality of floor panels in a box includes floor panels having a top layer and a bottom layer. The top layer has a top surface with a visible decorative pattern and a bottom surface adhered to a top surface of the bottom layer such that the bottom layer is offset from the top layer in a direction of length and width and a marginal end portion of the top surface of the bottom layer and a marginal end portion of the bottom surface of the top layer is exposed. At least one of the marginal end portions has an adhesive. The floor panels are stacked in the box in pairs. Each of the pairs is stacked such that the top surfaces of the top layers of each of the pairs of the floor panels are facing each other.

DETAILED DESCRIPTION OF THE EMBODIMENT(S)

Figure 1:
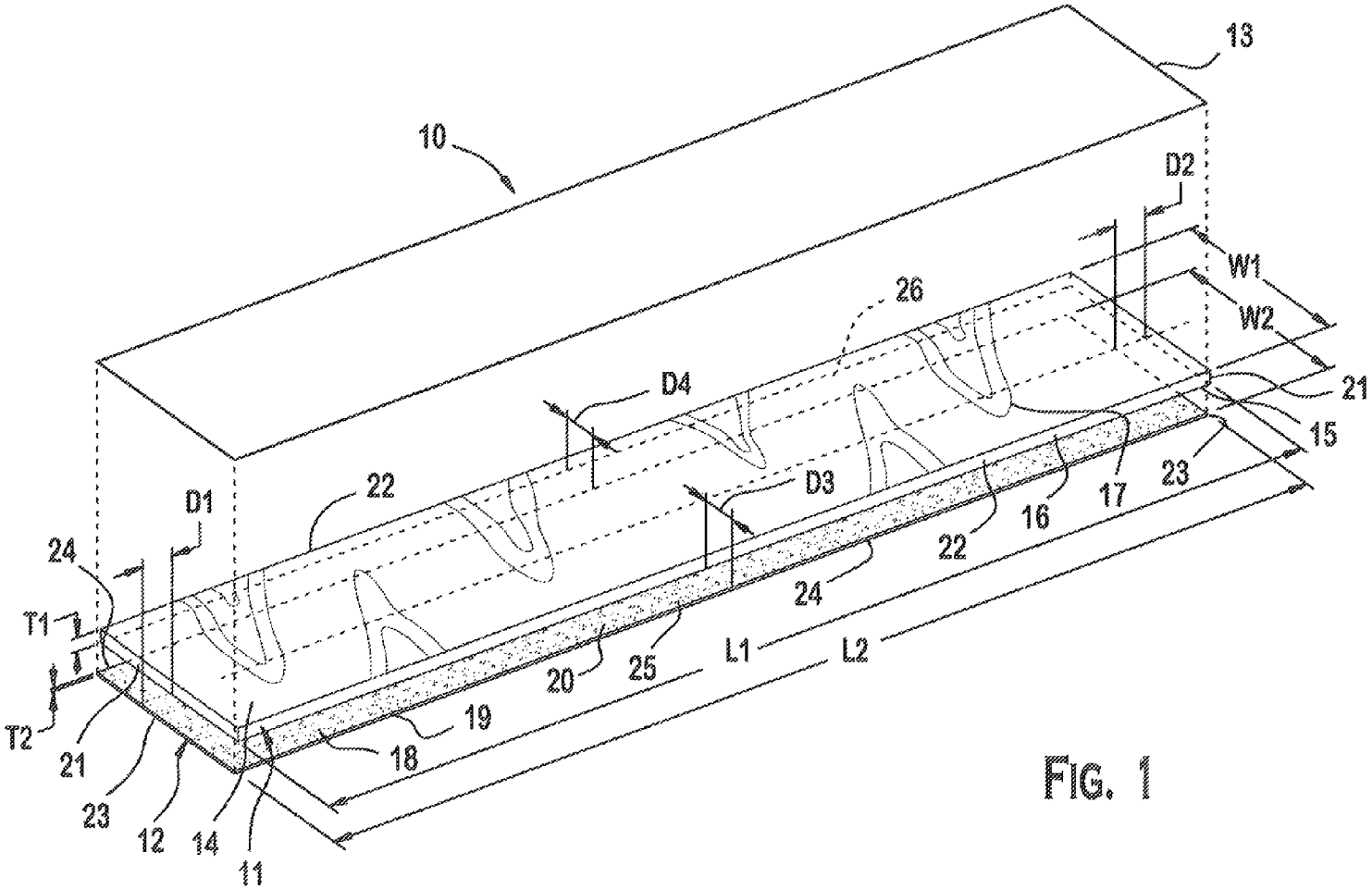
FIG. 1 is a perspective view of a floor panel according to an embodiment of the invention.
Figure 2:
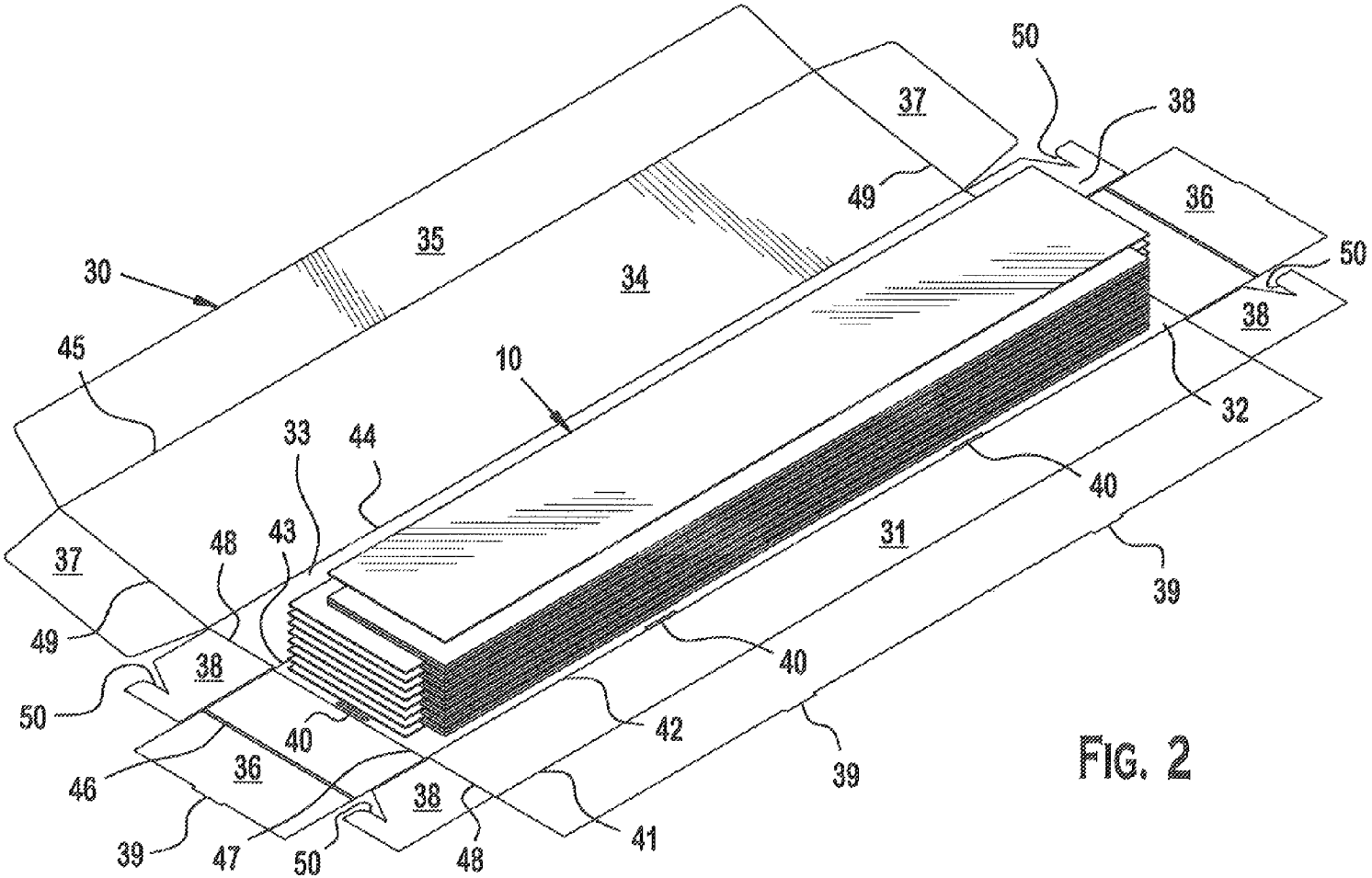
FIG. 2 is a perspective view of a box of shown in an open position.
Figure 3:
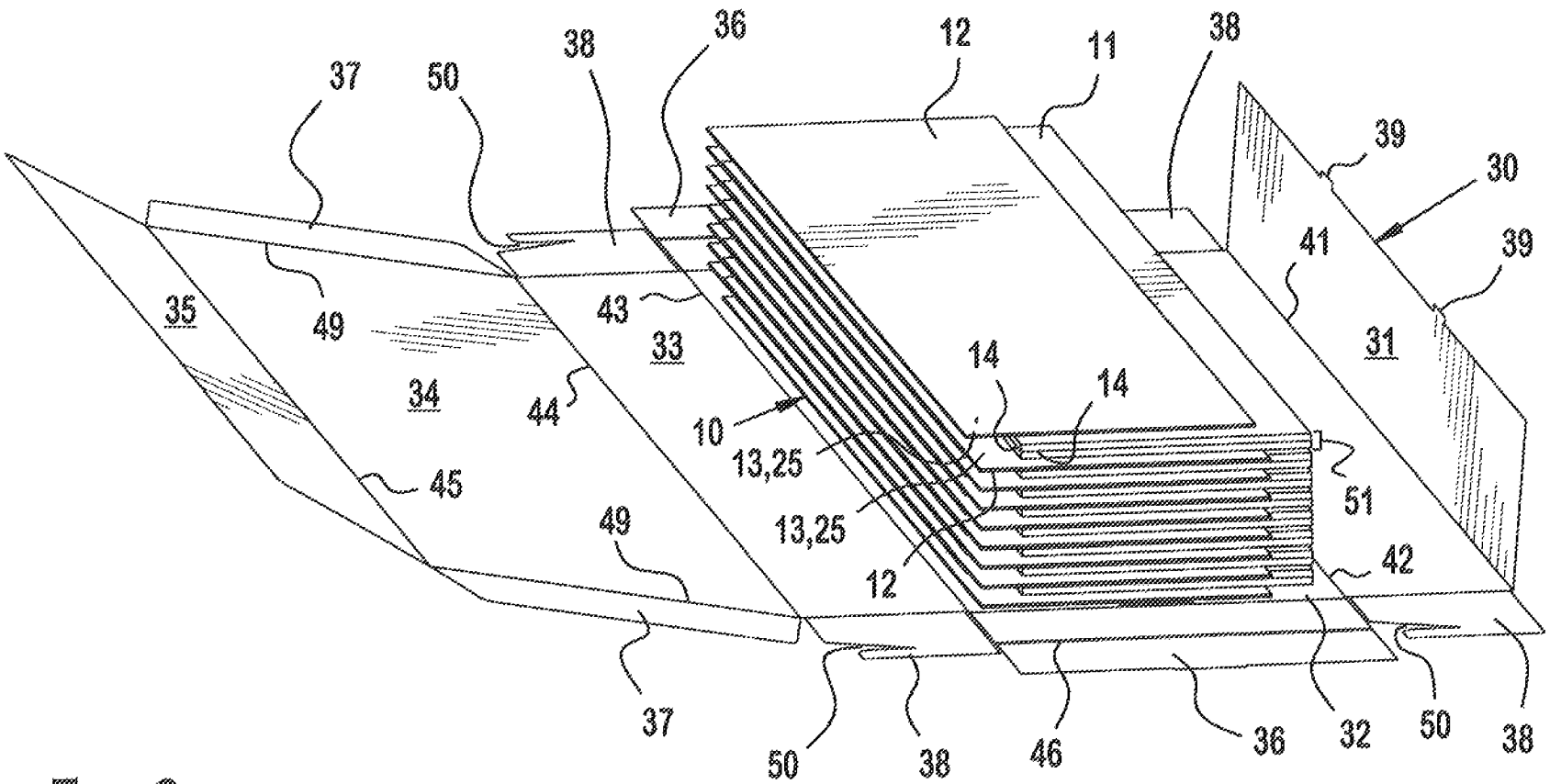
FIG. 3 is a perspective view of a plurality of the floor panels stacked in the box.

FIGS. 1-3 show a floor panel 10 according to a first embodiment of the invention. As shown in FIG. 1, the floor panel 10 comprises a top layer 11, a bottom layer 12, and a release member 13. The top layer 11 may be formed, for example, from a substantially flexible sheet material, such as plastic, vinyl, polyvinyl chloride, polyester, or combinations thereof. The top layer 11 has a top surface 14 with a visible decorative pattern 17 and a bottom surface 15. In the illustrated embodiment, the top layer 11 comprises at least one mix layer 16, a print film provided with the visible decorative pattern 17, a wear layer (not shown), and a top coat (not shown), respectively. It will be appreciated by those skilled in the art that although the top layer 11 is shown and described herein as comprising multiple layers that the top layer 11 may alternatively comprise a single layer. Additionally, the types of layers constituting the top layer 11 and the visible decorative pattern 17 could be varied depending on the desired characteristics of the top layer 11.

As shown in FIG. 1, the top layer 11 has a thickness T1 of about 20-200 mils (about 0.508-5.08 millimeters), preferably about 60-180 mils (about 1.524-4.572 millimeters), and more preferably about 80-150 mils (about 2.032-3.810 millimeters). In the illustrated embodiment, the top layer 11 is substantially rectangular in shape and has a length L1 of about 36 inches (about 91.4 centimeters) and a width W1 of about 6 inches (about 15.2 centimeters). However, it will be appreciated by those skilled in the art that the geometrical shape and the length L1 and the width W1 of the top layer 11 may be varied depending on the desired dimension and geometrical configuration of the floor panel 10. For example, the top layer 11 may alternatively have a substantially square shape.

As shown in FIG. 1, the bottom layer 12 has a top surface 18 and a bottom surface 19. The bottom layer 12 may be formed, for example, from a film or tape comprising plastic, vinyl, polyvinyl chloride, polyester, polyolefin, nylon, or combinations thereof. The bottom layer 12 may also include recycle material, such as post industrial or post consumer scrap. The film or tape may be rigid or flexible and is preferably moisture resistant or waterproof. Additionally, the film or tape may be capable of being delivered or shipped in a roll. In the illustrated embodiment, the bottom layer 12 comprises a single layer of rigid black polyvinyl chloride film. Alternatively, the bottom layer 12 could comprise multiple layers, such as two layers of film laminated with a mat, such as a glass mat or polyethylene terephthalate mat, there between. The bottom layer 12 could also be provided with at least one of a continuous or discontinuous ink layer, antimicrobial layer, sound deadening layer, cushioning layer, slide resistant layer, stiffening layer, channeling layer, mechanically embossed texture, or chemical texture.

As shown in FIG. 1, the bottom layer 12 has a thickness T2 less than the thickness T1 of the top layer 11. The thickness T2 of the bottom layer 12 is, for example, about 1-60 mils (about 0.0254-1.524 millimeters), preferably about 6.5-12 mils (about 0.1651-0.3048 millimeters), and more preferably about 8 mils (about 0.2032 millimeters). A ratio of the thickness T1 of the top layer 11 to the thickness T2 of the bottom layer 12 is about 5 or greater, preferably about 10-100, and more preferably about 10-25. The bottom layer 12 has a length L2 and a width W2 the same as the length L1 and the width W1 of the top layer 11. Thus, in the illustrated embodiment, the bottom layer 12 is substantially rectangular in shape and has the length L2 of about 36 inches (about 91.4 centimeters) and the width W2 of about 6 inches (about 15.2 centimeters). However, it will be appreciated by those skilled in the art that the geometrical shape and the length L1 and the width W1 of the bottom layer 12 may be varied depending on the desired dimension and geometrical configuration of the floor panel 10. For example, the bottom layer 12 may alternatively have a substantially square shape.

As shown in FIG. 1, the bottom surface 15 of the top layer 11 is laminated to the top surface 18 of the bottom layer 12 by an adhesive 20. The adhesive 20 may be, for example, any suitable adhesive, such as a hot melt adhesive, a pressure sensitive adhesive, or a structural and/or reactive adhesive. In the illustrated embodiment, the adhesive is a pressure sensitive acrylic adhesive. The adhesive 20 may have, for example, a bond strength of at least 25 force-pounds, and more preferably about 25-30 force-pounds after having been heat aged for about 24 hours at 145 degrees Fahrenheit. In the illustrated embodiment, the adhesive 20 is provided on substantially an entirety of the top surface 18 of the bottom layer 12. The adhesive 20 may be applied to have a thickness, for example, of about 1-2 mils (about 0.0254-0.0508 millimeters). It will be appreciated by those skilled in the art, however, that the thickness of the adhesive 20 may vary depending on the texture of the bottom surface 15 of the top layer 11 and the texture of the top surface 18 of the bottom layer 12 in that a substantially smooth surface would require less of the adhesive 20 due to better adhesion and bond strength.

The top layer 11 is adhered to the bottom layer 12 so that the top layer 11 is offset from the bottom layer 12 in a direction of the length L1, L2 and the width W1, W2. In other words, opposing first ends 21 of the top layer 11 are offset in the direction of the length L1, L2 from opposing first ends 23 of the bottom layer 12 an offset distance D1, D2 and opposing second ends 22 of the top layer 11 are offset in the direction of the width W1, W2 from opposing second ends 24 of the bottom layer 12 an offset distance D3, D4. The offset distances D1, D2, D3, D4 are substantially the same. In the illustrated embodiment, the offset distances D1, D2, D3, D4 are, for example, about 1 inch (about 2.5 centimeters). It will be appreciated by those skilled in the art, however, that the offset distances D1, D2, D3, D4 may be varied depending on the desired configuration of the floor panel 11. Examples of possible variations in the offset distances D1, D2, D3, D4 are set forth, for example, in U.S. patent application Ser. No. 12/412,419, filed Mar. 27, 2009, which is hereby incorporated by reference in its entirety. Because the adhesive 20 is provided on substantially the entirety of the top surface 18 of the bottom layer 12, due to the offset of the top layer 11 relative to the bottom layer 12, a substantially L-shaped marginal end portion of the top surface 18 of the bottom layer 12 remains exposed to form an adhesive surface 25, and a substantially L-shaped marginal end portion of the bottom surface 15 of the top layer 11 remains exposed to form an attachment surface 26.

It will be appreciated by those skilled in the art that the adhesive 20 may also be provided on the marginal end portion of the bottom surface 15 of the top layer 11 instead of or in addition to the top surface 18 of the bottom layer 12 depending on the type and characteristics of the adhesive 20 used to achieve optimum adhesion and bond strength when adhering the adjacent floor panels 10, as described in more detail below with reference to FIGS. 2-3. Further, the adhesive 20 used to adhere the top layer 11 to the bottom layer 12 may be different from the adhesive 20 provided on the marginal end portions of the top layer 11 and and/or the bottom layer 12.

As shown in FIG. 1, the release member 13 is positioned adjacent to the top surface 14 of the top layer 11 and the adhesive surface 25 to cover the adhesive surface 25 during shipping of the floor panel 10 and prior to the installation thereof. In the illustrated embodiment, the release member 13 is a flexible sheet corresponding in size and shape to the bottom layer 12. It will be appreciated by those skilled in the art, however, that the size and shape of the release member 13 may be varied, as long as the release member 13 adequately covers the adhesive surface 25. For example, the release member 13 could just correspond in size and shape to the substantially L-shaped marginal end portion of the top surface 18 of the bottom layer 12. The release member 13 may be made, for example, from any known suitable release material, such as a poly or silicone coated paper, a plastic sheet, a polymer film, or other material that enables the release member 13 to be quickly and easily removed from the adhesive surface 25 during the installation of the floor panel 10. The release member 13 may additionally be provided with a tab (not shown) that extends from the release member 13 in order to increase the ease of removal of the release member 13 from the adhesive surface 25 during the installation of the floor panel 10.

A packaging system for the floor panel 10 will now be described in greater detail with reference to FIGS. 2-7. As shown in FIG. 2, the packaging system comprises a substantially rectangular box 30. The box 30 consists of a consecutive attachment of a first side panel 31, a bottom panel 32, a second side panel 33, a top panel 34, and an attachment panel 35. Bottom end panels 36 extend from opposing ends of the bottom panel 32. Top end panels 37 extend from opposing ends of the top panel 34. Tabs 38 extending from opposing ends of the first and second side panels 31, 33. Tabs (not shown) may also optionally extend from opposing ends of the attachment panel 35. Notches 50 are provided in opposing ends of each of the tabs 38. Projections 41 extend from end surfaces of the first side panel 31 and the bottom end panels 36. The projections 41 correspond to projection receiving openings 42 formed in the bottom panel 32.

The first side panel 31, the bottom panel 32, the second side panel 33, the top panel 34, and the attachment panel 35 have a length substantially corresponding to a total length of the floor panel 10, wherein the total length of the floor panel 10 is about equal to the length L2 of the bottom layer 12 plus the offset distance D2 of the top layer 11. The bottom panel 32 and the top panel 34 have a width substantially corresponding to a total width of the floor panel 10, wherein the total width of the floor panel 10 is about equal to the width W2 of the bottom layer 12 plus the offset distance D4 of the top layer 11.

A first crease 41 is provided in an approximately a center of the first side panel 31. A second crease 42 is provided between the first side panel 31 and the bottom panel 32. A third crease 43 is provided between the bottom panel 32 and the second side panel 33. A fourth crease 44 is provided between the second side panel 33 and the top panel 34. A fifth crease 45 is provided between the top panel 34 and the attachment panel 35. Sixth creases 46 are provided in an approximate center of each of the bottom end panels 36. Seventh creases 47 are provided between each of the bottom end panels 36 and the bottom panel 32. Eighth creases 48 are provided between each of the tabs 38 and the first and second side panels 31, 33. Ninth creases 49 are provided between each of the top end panels 37 and the top panel 34.

As shown in FIG. 3, a plurality of the floor panels 10 is stacked on the bottom panel 32 of the box 30. The floor panels 10 are stacked in pairs 51. Each of the pairs 51 is stacked such that the top surface 14 of the top layers 11 of each of the pairs 51 of the floor panels 10 are facing each other. Additionally, the floor panels 10 are all stacked in the same direction so that the unsupported marginal end portions of the bottom layer 12 provided with the release paper 13 that covers the adhesive surface 25 are positioned adjacent to each other.

Figure 4:
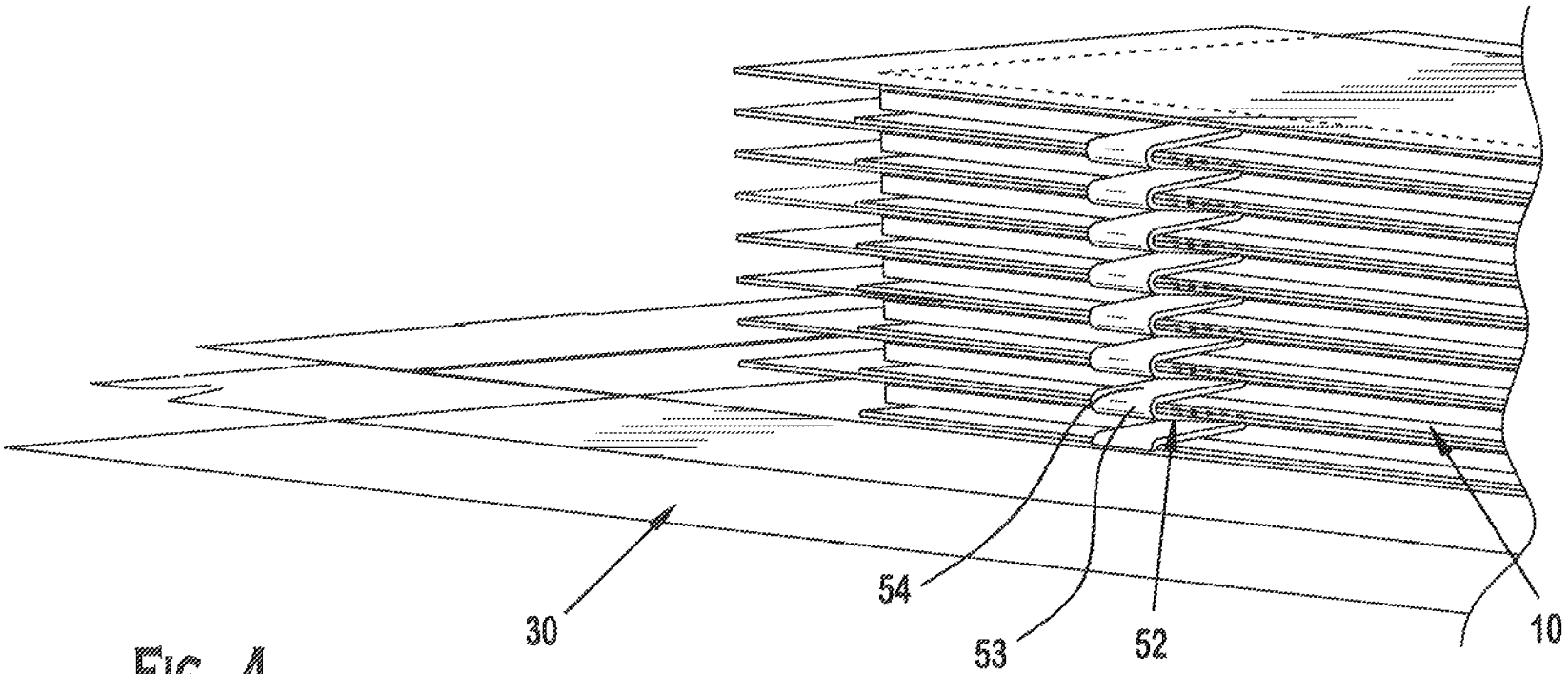
FIG. 4 is a perspective view of a support inserted in-between the floor panels stacked in the box.

As shown in FIG. 4, at least one support 52 may optionally be provided to additionally support and prevent damage to the unsupported marginal end portions of the bottom layers 12. The support 52 has a substantially accordion-like profile and is provided with a plurality of folds 53 that form a plurality of opposing substantially v-shaped openings 54. Each of the folds 53 is inserted in a space formed adjacent the abutting top surfaces 14 of the top layers 11 of each of the pairs 51 so that the openings 54 receive the unsupported marginal end portions of the bottom layers 12 of one of each of the adjacent pairs 51. The supports 52 may be provided, for example, at several positions along the side of the stack of the floor panels 10 with the unsupported marginal end portions of the bottom layers 12.

Figure 5:
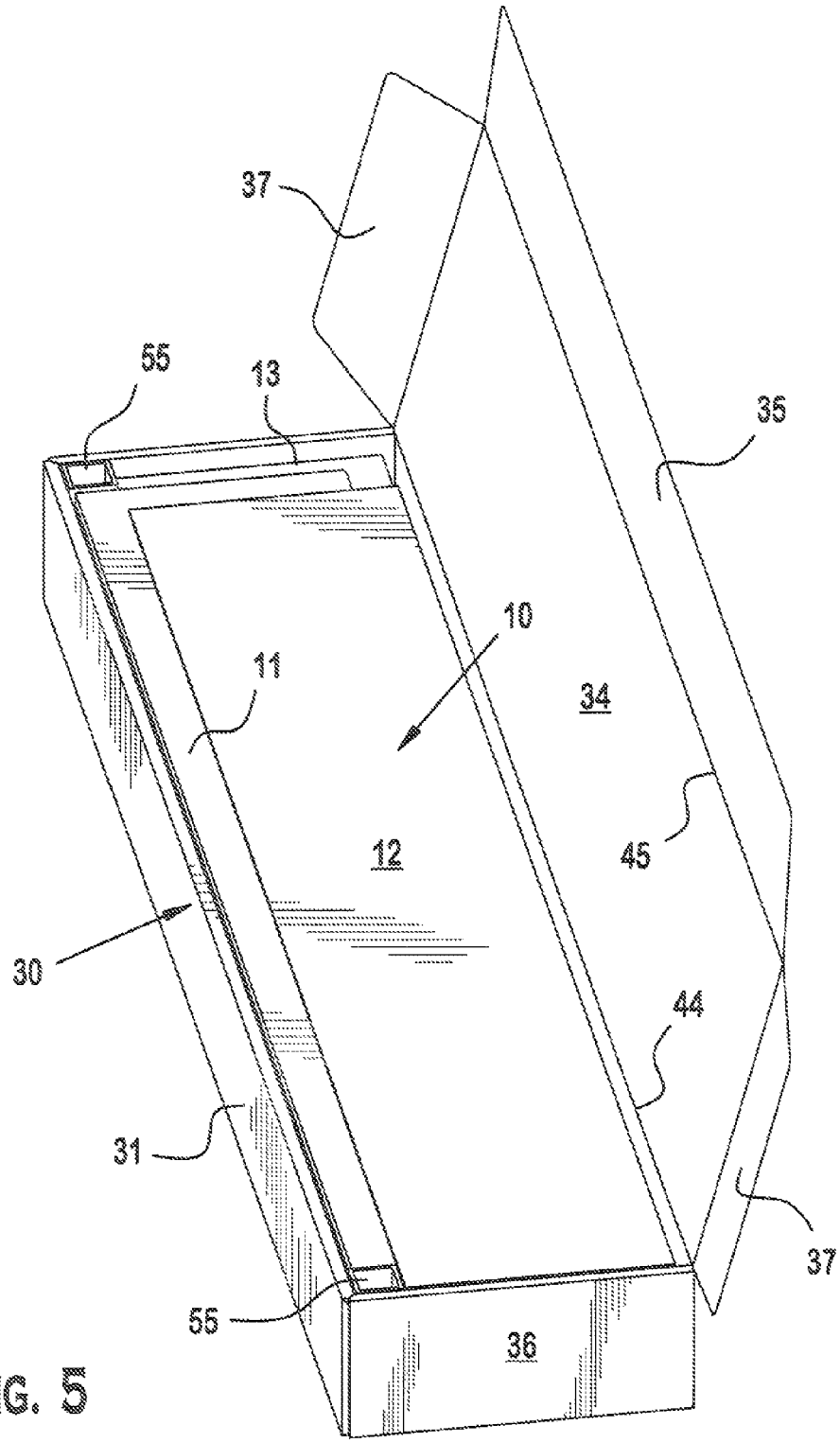
FIG. 5 is a perspective view of the box in a partial closed position.

As shown in FIG. 5, after the floor panels 10 are stacked on the bottom panel 32, and the supports 52 are optional provided on the floor panels 10, the box 30 is partially closed. In order to partially close the box 30, the bottom end panels 36 are folded about the sixth creases 46, and the projections 39 of the bottom end panels 36 are inserted into the projection receiving openings 40 in the bottom panel 32. Simultaneously, the bottom end panels 36 are folded about the seventh creases 47 toward the floor panels 10. The first side panel 31 is folded about the first crease 41, and the projections 39 of the first side panel 31 are inserted into the projection receiving openings 40 in the bottom panel 32. Simultaneously, the first side panel 31 is folded about the second crease 42 toward the floor panels 10, and the tabs 38 of the first side panel 31 are folded inward about the eighth creases 48 and inserted into the bottom end panels 36. The second side panel 33 is folded about the third crease 43 toward the floor panels 10, and the tabs 38 of the second side panel 33 are folded inward about the eighth creases 48 and inserted into the bottom end panels 36. The top panel 34 is then folded about the fourth crease 44.

Figure 6:
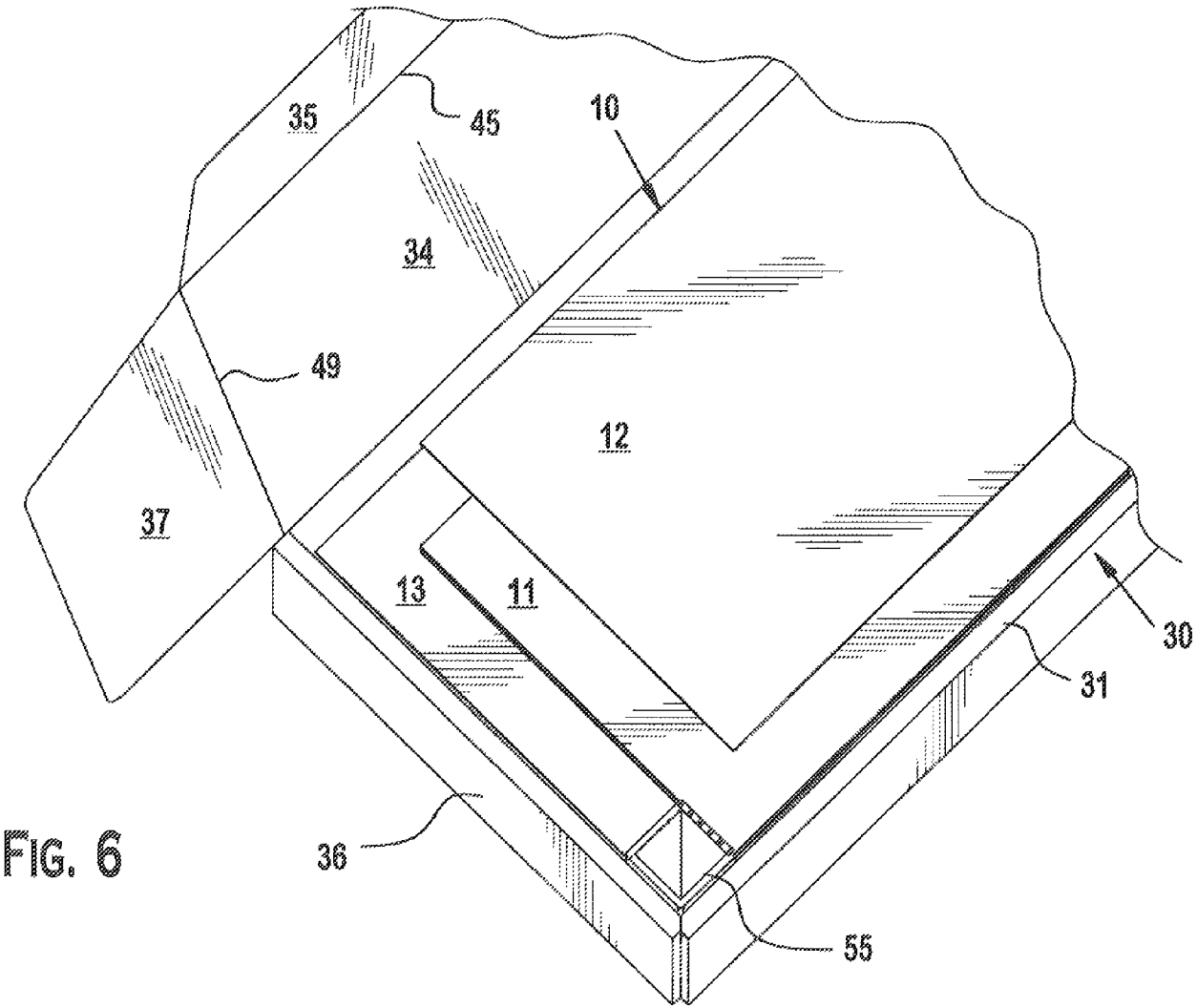
FIG. 6 is a perspective view of the box in a partial closed position.

As shown in FIGS. 5-6, before or after the box 30 is partially closed, corner supports 55 may be provided in the box 30. The corner supports 55 are substantially rectangular blocks, may be solid or hollow, and may be formed, for example from plastic, cardboard, styrofoam, wood, or other similar material. Although the supports 55 are shown and described herein as being separate pieces from the box 30, it will be appreciated by those skilled in the art that the supports 55 may alternatively be integrally formed with the box 30. The supports 55 are provided in the empty spaces in at least one corner of the box 30 and preferably two opposing corners of the box 30 to further stabilize the floor panels 10 therein. It will be appreciated by those skilled in the art, however, that additional supports 55 may be provided, as necessary, to further stabilize the floor panels 10 in the box 30.

Figure 7:
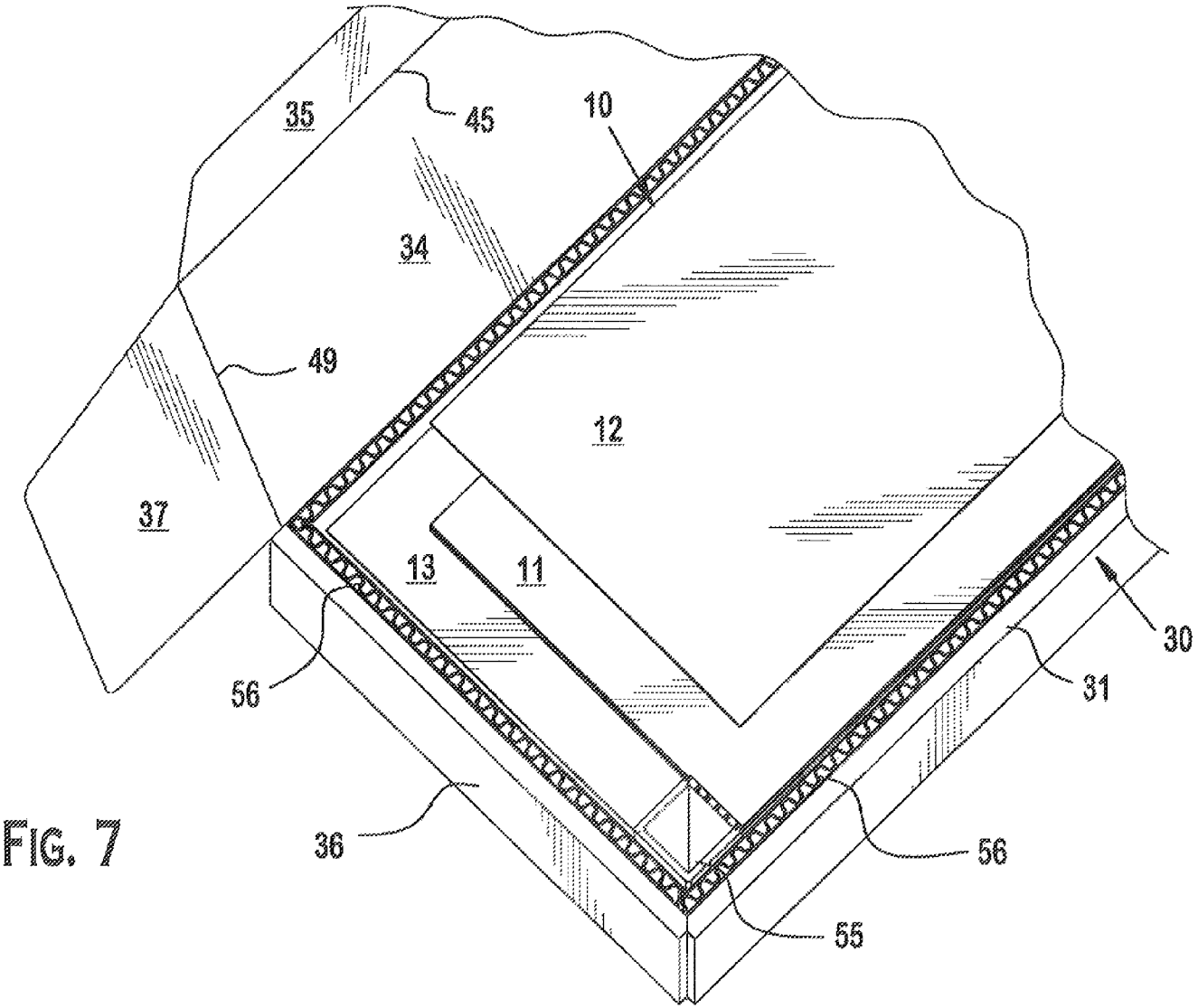
FIG. 7 is a perspective view of an insert provided in the box.

As shown in FIG. 7, an insert 56 may optionally be provided to provide additional support to the first side panel 31, the second side panel 33, and the bottom end panels 36 of the box 30, thereby further protecting the floor panels 10 from damage. In the illustrated embodiment, the insert 56 is positioned adjacent to and extends substantially parallel to the first side panel 31, the second side panel 33, and the bottom end panels 36 of the box 30. Alternatively, or in addition, the insert 56 may be sandwiched between opposing sides of the first side panel 31, which opposing sides are created after folding the first side panel 31 about the first crease 41, and between opposing sides of the bottom end panels 36, which opposing sides are created after folding the bottom end panels 36 about the sixth creases 46. The insert 56 may be formed, for example, from C-flute corrugated cardboard, foam, or other similar material.

Figure 8:
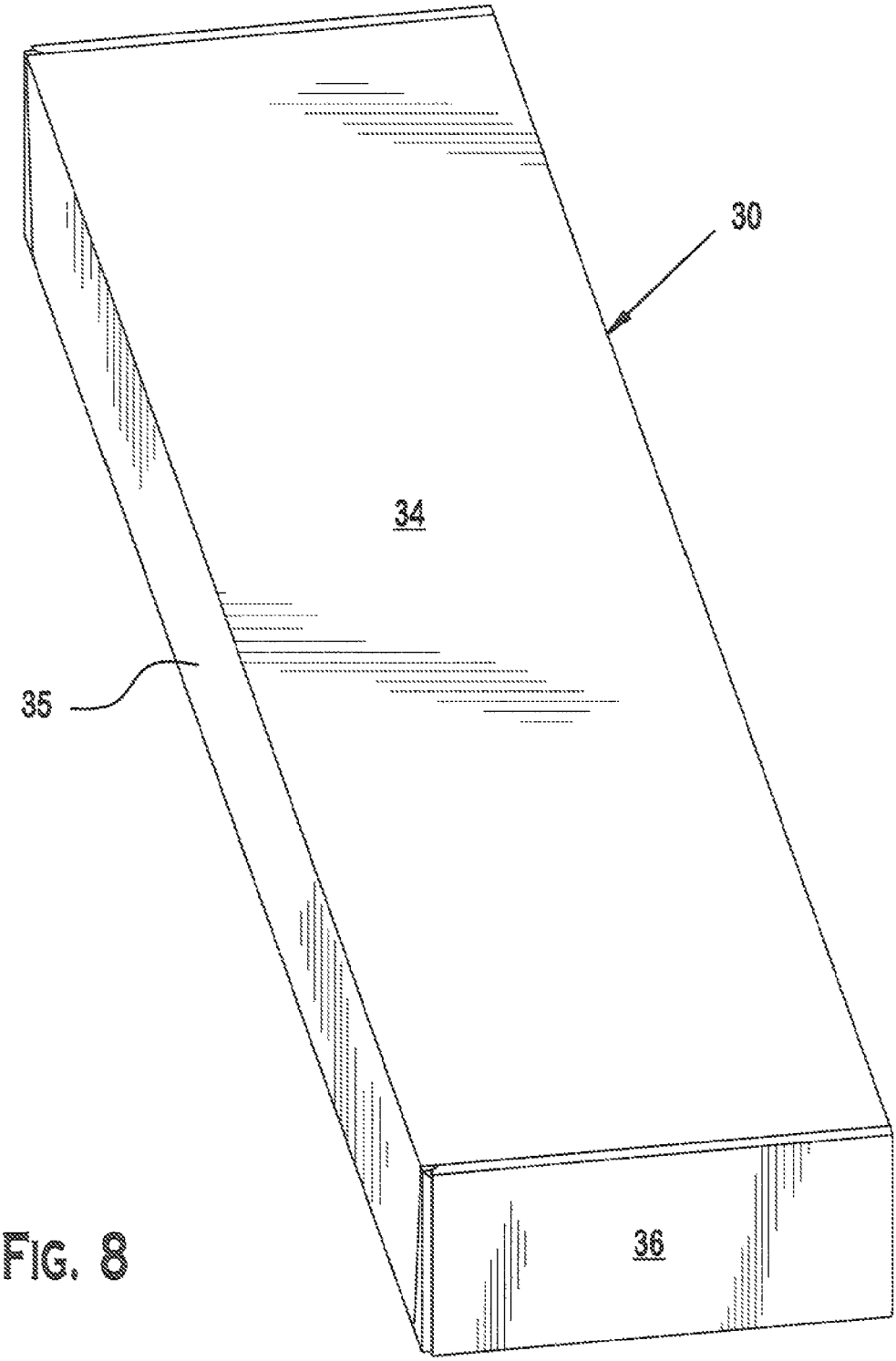
FIG. 8 is a perspective view of the box in a closed position.

As shown in FIG. 8, in order to close the box 30, an adhesive (not shown) is applied to the inner surface of the attachment panel 35 and/or an outer surface of the first side panel 31. The attachment panel 35 is folded inward about the fifth crease 45 until the inner surface of the attachment panel 35 contacts the outer surface of the first side panel 31 thereby adhering the attachment panel 35 to the first side panel 31. Additionally, if tabs (not shown) are provided on opposing ends of the attachment panel 35, the tabs (not shown) of the attachment panel 35 would be folded inward and inserted into the first side panel 31 during the aforementioned folding process. An adhesive (not shown) is also applied to the inner surface of the top end panels 37 and/or an outer surface of the bottom end panels 36. The top end panels 27 are folded inward about the ninth creases 49 until the inner surface of the top end panels 27 contact the outer surface of the bottom end panels 36 thereby adhering the top end panels 27 to the bottom end panels 36. The box 30 is thereby closed. The packaging system as provided herein not only adequately protects and supports the floor panels 10, but also prevents damage to the unsupported marginal end portions of the bottom layers 12 during shipping.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A packaging system, comprising:

a plurality of floor panels, each of the floor panels comprising a top layer and a bottom layer, the top layer having a top surface with a visible decorative pattern and a bottom surface adhered to a top surface of the bottom layer such that the bottom layer is offset from the top layer in a direction of length and width and a marginal end portion of the top surface of the bottom layer and a marginal end portion of the bottom surface of the top layer is exposed, at least one of the marginal end portions having an adhesive, the floor panels having a ratio of a thickness of the top layer to a thickness of the bottom layer of about 5 or greater;

a box containing the plurality of floor panels, the floor panels being stacked in the box in pairs, each of the pairs being stacked such that the top surface of the top layers of each of the pairs of the floor panels are facing each other, the floor panels being stacked in the same direction so that the marginal end portions of the bottom layers are positioned adjacent to each other, the box having a length substantially corresponding to a total length of the stacked floor panels and a width substantially corresponding to the width of a respective floor panel; and corner supports provided in respective corners of the box to stabilize the floor panels in the box and to prevent damage to the marginal end portions of the bottom layer during shipping;

wherein the facing top layers provide support to each other to prevent the marginal end portions of the top layers from bending as the floor panels are retained in the box.

2. The packaging system of claim 1, further comprising a support, the support provided with a plurality of folds and openings, the folds being positioned in a space that is adjacent the top surfaces of the top layers of each of the pairs so that the openings receive the marginal end portions of the bottom layers of one of each of the adjacent pairs, the support providing additional support to prevent the marginal end portion of the top layers from bending as the floor panels are retained in the box.

3. The packaging system of claim 1, wherein the box includes a top panel, a bottom panel, a first side panel, a second side panel, and bottom end panels wherein when the box is in a closed position the top panel opposes the bottom panel, the first side panel opposes the second side panel, and the bottom end panels oppose each other, and an insert is positioned adjacent to and extends substantially parallel to at least one of the first side panel, the second side panel, or the bottom end panels.

4. The packaging system of claim 1, wherein each of the floor panels further comprises a release member adjacent the adhesive.

5. The packaging system of claim 1, wherein the marginal end portions are substantially L-shaped.

6. The packaging system of claim 1, wherein the top layer comprises a mix layer.

7. The packaging system of claim 1, wherein the bottom layer is a film or tape comprising plastic, vinyl, polyvinyl chloride, polyester, polyolefin, or nylon.

8. The packaging system of claim 1, wherein the ratio of the thickness of the top layer to the thickness of the bottom layer is about 10-100.

9. The packaging system of claim 8, wherein the ratio of the thickness of the top layer to the thickness of the bottom layer is about 10-25.

10. A method of packaging a plurality of floor panels in a box, comprising:

providing a plurality of floor panels, each of the floor panels comprising a top layer and a bottom layer, the top layer having a top surface with a visible decorative pattern and a bottom surface adhered to a top surface of the bottom layer such that the bottom layer is offset from the top layer in a direction of length and width and a marginal end portion of the top surface of the bottom layer and a marginal end portion of the bottom surface of the top layer is exposed, at least one of the marginal end portions having an adhesive, the floor panels having a ratio of a thickness of the top layer to a thickness of the bottom layer is about 5 or greater;

stacking the floor panels in the box in pairs, each of the pairs being stacked such that the top surface of the top layers of each of the pairs of the floor panels are facing each other, each of the pairs being stacked in the same direction so that the marginal end portions of the bottom layers are positioned adjacent to each other, the box having a length substantially corresponding to a total length of the stacked floor panels and a width substantially corresponding to the width of a respective floor panel; and providing corner supports provided in respective corners of the box to stabilize the floor panels in the box and to prevent damage to the marginal end portions of the bottom layer during shipping;

wherein the facing top layers providing support to each other, preventing the marginal end portions of the top layers from bending as the floor panels are retained in the box.

11. The method of claim 10, further comprising inserting a support between the pairs of floor panels, the support having a plurality of folds and openings, the folds being positioned in a space that is adjacent the top surfaces of the top layers of each of the pairs so that the openings receive the marginal end portions of the bottom layers of one of each of the adjacent pairs, the support further preventing the marginal end portion of the top layers from bending as the floor panels are retained in the box.

12. The method of claim 10, wherein the box includes a top panel, a bottom panel, a first side panel, a second side panel, and bottom end panels wherein when the box is in a closed position the top panel opposes the bottom panel, the first side panel opposes the second side panel, and the bottom end panels oppose each other, and an insert is positioned adjacent to and extends substantially parallel to at least one of the first side panel, the second side panel, or the bottom end panels.

13. The method of claim 10, wherein each of the floor panels further comprises a release member adjacent the adhesive.

14. The method of claim 10, wherein the marginal end portions are substantially L-shaped.

15. The method of claim 10, wherein the top layer comprises a mix layer.

16. The method of claim 10, wherein the bottom layer is a film or tape comprising plastic, vinyl, polyvinyl chloride, polyester, polyolefin, or nylon.

17. The method of claim 10, wherein the ratio of the thickness of the top layer to the thickness of the bottom layer is about 10-100.

18. The method of claim 17, wherein the ratio of the thickness of the top layer to the thickness of the bottom layer is about 10-25.

* * * * *